United States Patent [19]

Takamatsu

[11] 4,036,524

[45] July 19, 1977

[54] CHAIR

[75] Inventor: Ikuo Takamatsu, Uozu, Japan

[73] Assignee: Yoshida Kogyo Kabushiki Kaisha, Tokyo, Japan

[21] Appl. No.: 651,402

[22] Filed: Jan. 22, 1976

[30] Foreign Application Priority Data

Feb. 6, 1975 Japan ..... 5017107[U]

[51] Int. Cl.[2] ..... A47C 27/00

[52] U.S. Cl. ..... 297/219

[58] Field of Search ..... 297/218, 219, 223, 283

[56] References Cited

U.S. PATENT DOCUMENTS

| | | | |
|---|---|---|---|
| 2,233,986 | 3/1941 | Leech | 297/218 |
| 3,515,430 | 2/1970 | Nelson | 297/218 |

*Primary Examiner*—James C. Mitchell

*Attorney, Agent, or Firm*—Dennison, Dennison, Meserole & Pollack

[57] ABSTRACT

A chair of a relatively simple construction is disclosed, which essentially comprises a seat and a back-rest interconnected therewith by a sliding clasp fastener. The back-rest in particular is clad with a cover attached with one of a pair of fastener stringers, the other stringer being attached to a marginal edge of the seat or its cover.

2 Claims, 4 Drawing Figures

CHAIR

BACKGROUND OF THE INVENTION

This invention relates to improvements in and relating to chairs of the type which essentially comprises a seat and a back-rest.

Numerous forms and constructions of chairs are known, some of which are provided with covers made of cloth, leather or other suitable materials with a view to protecting the seat and/or back-rest against wear and smear, or for aesthetic purposes. A typical example of such chair has both a seat and a back-rest covered integrally by a one-piece cover. Another such example has two separate covers, one for the seat and the other for the back-rest. The former example has a drawback in that when part of the cover is smeared or damaged, the whole of the cover must be removed. Such economical drawback may be overcome by the latter example in which the respective covers for the seat and the back-rest can be removed independently one from the other. However, covers that are loosely placed over the back-rest as in conventional use are prone to get tucked up or creased in repeated contact with the back of the user. To eliminate this difficulty, strings or bands have been provided with which to keep taut and fasten the cover to the back-rest or its support arm.

Such charis are very unsightly and disadvantageous in that fastening the cover with strings or bands to the back-rest is extremely tedious.

SUMMARY OF THE INVENTION

With the foregoing deficiencies of the prior-art chairs in view, it is a primary object of the present invention to provide an improved chair which has its back-rest in particular clad with a cover which is easy to mount and dismount, can be retained in place against displacement, and maintains taut and neat appearance over extended periods of use.

Briefly stated, the chair according to the invention is provided with a back-rest cover made of cloth, leather or the like which is separably connected by a sliding clasp fastener to a marginal edge of a seat or its cover. The sliding clasp fastener is provided with a separator including a pin and a socket for separating the fastener into identical halves when desired to remove the back-rest cover.

The invention can be best understood from the following description to be read with reference to the accompanying drawings in which like numerals refer to like parts.

DETAILED DESCRIPTION OF THE PREFERRED EMBODIMENTS

Figure 1:
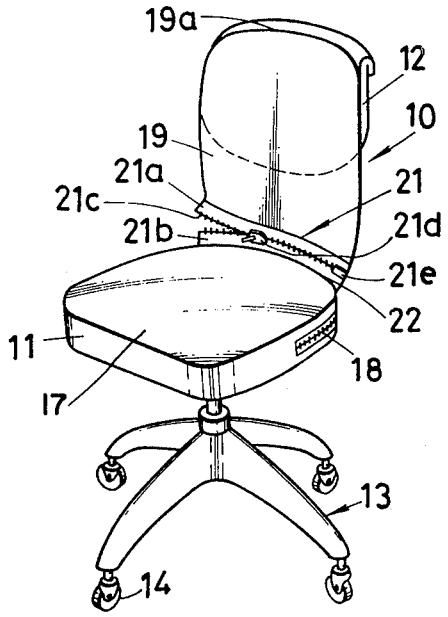
FIG. 1 is a perspective view of a chair provided in accordance with a preferred embodiment of the invention.

Referring now to the drawings and FIG. 1 in particular, there is shown a chair 10 provided in accordance with the invention, which chair essentially comprises a seat 11 and a back-rest 12. The seat 11 is supported pivotally on support legs 13 each having a roller 14 adapted for moving the chair 10.

Figure 2:
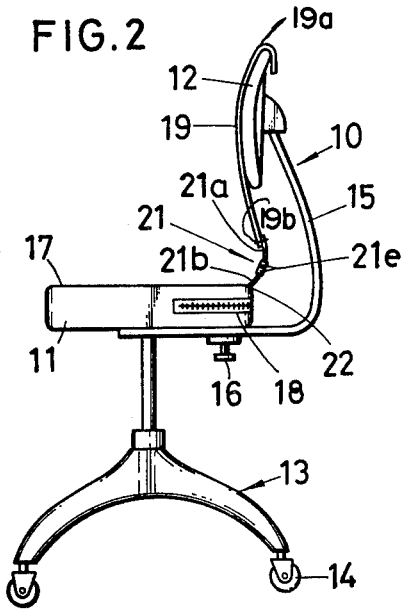
FIG. 2 is a side elevation of the same.
Figure 3:
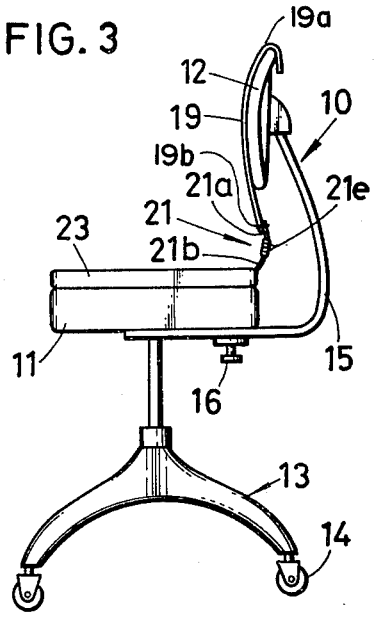
FIG. 3 is a view similar to FIG. 2 but showing a modified form of chair embodying the invention.

As shown in FIGS. 2 and 3, the back-rest 12 is supported on the seat 11 by means of a support arm 15 extending there between. Designated a 16 is an adjusting knob provided for adjusting the position of the back-rest 12 in the well-known manner. other details of the construction of the chair 10 are conventional and hence will require no further description.

In the embodiment illustrated in FIGS. 1 and 2, the seat 11 is covered with an overlay 17 of cloth, leather or any other suitable covering material. The overlay or cover 17 is in the form of a bag substantially conforming to the contours of the seat 11 and having attached at one end a sliding clasp fastener 18 with which to mount and dismount the cover 17. The back-rest 12 is also provided with an overlay or cover 19 having one or a top end **19*a* removably connected to a hook so provided at and behind the top end portion of the back-rest 12, and the other or a bottom end 19*b* attached to a sliding clasp fastener 21. The fastener 21 shown is of a known separable construction and comprises a pair of oppositely disposed stringers 21*a*, *21b* each carrying along one longitudinal edge a row of interlocking fastener elements 21*c*, a slider 21*d* movable along the stringers 21*a*, *21b* to take them into and out of engagement, and a separator 21*e* including a pin and a socket (both not shown) and adapted for separating the fastener. According to the invention, one stringer 21*a* of the fastener 21 is secured as by sewn stitches to the bottom end 19*b* of the back-rest cover 19, and the other stringer 21*b* to an upper marginal edge 22 of the seat cover 17, whereby the back-rest 12 is separably connected to the seat 11. The back-rest cover 19 should be preferably substantially as wide as the seat cover 17, so that the two covers can be interconnected by the fastener 21 with ease and neatly. The back-rest cover 19 should also be of such a length that the cover 19 can be kept properly taut when the fastener 21 is closed to interconnect it with the seat cover17**.

The provision of a sliding clasp fastener 21 is advantageous in that the back-rest cover 19 can be taken readily into and out of connecting engagement with the seat cover 17 and can be held neatly taut and in position against the tendency of its getting displaced or creased when subjected to frictional contact with the use of the chair.

FIG. 3 illustrates a modification in which the back-rest cover 19 is interconnected by the fastener 21 to a pad or cushion 23 laid over the seat 11.

Figure 4:
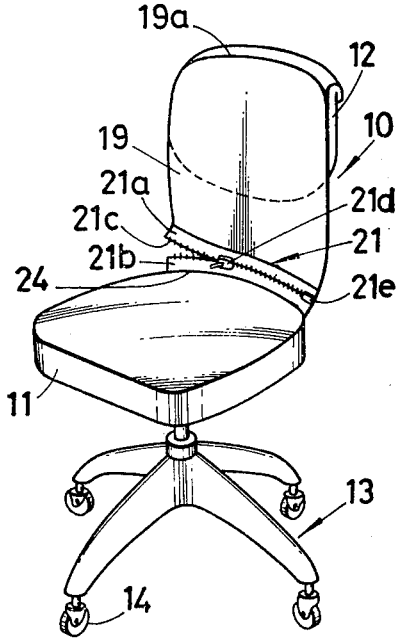
FIG. 4 is a view similar to FIG. 1 but showing a different embodiment of the invention.

FIG. 4 illustrates another modification in which the back-rest cover 19 is interconnected by the fastener 21 directly to an upper marginal edge 24 of the set 11.

Many other modifications or changes may be made in the form and construction of the chair 10 illustrated, but they should not depart from the scope of the appended claims.

What is claimed is:

1. In combination, a chair having a seat with an upper surface and a free rear upper marginal edge, support means depending from said seat, a back-rest supported in spaced relation above said seat and in general alignment with the free rear upper marginal edge of said seat, said back-rest having a free upper edge and a free front face, a single sheet protective cover of a width substantially equal to the width of the back-rest, said cover having a top edge engaged with and over the free upper edge of the back-rest, and a lower edge generally paralleling the free rear upper marginal edge of the seat in adjacent spaced relation thereabove, a separable sliding clasp fastener comprising a pair of stringers, one of said stringers being secured to and along said lower edge of the cover and depending therefore, the second of said stringers being secured to the free rear upper marginal edge of said seat and extending upwardly therefrom, said sliding clasp fastener further including a slider releasably interlocking said stringers, and thereby said back-rest cover and said seat, and providing a continuous exposed surface between the back-rest and the free upper marginal rear edge and upper surface of the seat.

2. In combination, a chair having a seat, a pad freely overlying said seat, said pad having an upper surface and a free rear upper marginal edge, support means depending from said seat, back-rest supported in spaced relation above said seat and said pad in general alignment witht the free rear upper marginal edge of said pad, said back-rest having a free upper edge and a free front face, a single sheet protective cover of a width substantially equal to the width of the back-rest, said cover having a top edge engaged with and over the free upper edge of the back-rest, and a lower edge generally paralleling the free rear upper marginal edge of the pad in adjacent spaced relation thereabove, a separable sliding clasp fastener comprising a pair of stringers, one of said stringers being secured to and along said lower edge of the cover and depending therefrom, the second of said stringers being secured to and along the free rear upper marginal edge of said pad and extending upwardly therefrom, said sliding clasp fastener further including a slider releasably interlocking said stringers, and thereby said back-rest cover and said seat pad, and providing a continuous exposed surface between the back-rest and the free rear upper marginal edge and upper surface of the seat overlying pad.

* * * * *